US011761286B2

(12) United States Patent
Robinson et al.

(10) Patent No.: US 11,761,286 B2
(45) Date of Patent: Sep. 19, 2023

(54) EROSION CONTROL SYSTEM

(71) Applicant: Cameron International Corporation, Houston, TX (US)

(72) Inventors: Stuart Robinson, Houston, TX (US); Jerry Martino, Houston, TX (US); Michael Krejci, Houston, TX (US); Abinesh Gnanavelu, Houston, TX (US)

(73) Assignee: CAMERON INTERNATIONAL CORPORATION, Houston, TX (US)

( * ) Notice: Subject to any disclaimer, the term of this patent is extended or adjusted under 35 U.S.C. 154(b) by 162 days.

(21) Appl. No.: 17/135,835

(22) Filed: Dec. 28, 2020

(65) Prior Publication Data

US 2021/0189837 A1 Jun. 24, 2021

Related U.S. Application Data

(63) Continuation of application No. 16/173,732, filed on Oct. 29, 2018, now Pat. No. 10,876,376.

(51) Int. Cl.

| | |
|---|---|
| ***E21B 41/00*** | (2006.01) |
| ***E21B 43/26*** | (2006.01) |
| ***E21B 33/068*** | (2006.01) |
| *E21B 33/03* | (2006.01) |

(52) U.S. Cl.
CPC ..... *E21B 41/00* (2013.01); *E21B 33/068* (2013.01); *E21B 43/26* (2013.01)

(58) Field of Classification Search
None
See application file for complete search history.

(56) References Cited

U.S. PATENT DOCUMENTS

| | | | |
|---|---|---|---|
| 4,624,327 | A | 11/1986 | Reichman |
| 5,197,509 | A | 3/1993 | Cheng |
| 5,529,084 | A | 6/1996 | Mutsakis et al. |

(Continued)

FOREIGN PATENT DOCUMENTS

WO 2014094143 A1 6/2014

OTHER PUBLICATIONS

International Search Report and Written Opinion issued in PCT Application PCT/US2019/058322, dated Feb. 17, 2020 (11 pages).

(Continued)

*Primary Examiner* — Matthew Troutman
*Assistant Examiner* — Douglas S Wood
(74) *Attorney, Agent, or Firm* — Matthew Goode

(57) ABSTRACT

A hydrocarbon extraction system that includes an erosion control system. The erosion control system includes a housing defining a first inlet, a second inlet, and an outlet. The housing receives and directs a flow of a particulate laden fluid between the first inlet and the outlet. A conduit rests within the housing. The conduit changes a direction of the particulate laden fluid and reduces erosion of the housing. The conduit is inserted into the housing through the second inlet. The conduit defines a plurality of apertures between an exterior surface and an interior surface of the conduit. The apertures direct the fluid into a conduit cavity. The conduit guides the fluid entering the conduit cavity to the outlet. The erosion control system excludes a plug and/or a sleeve around or in the conduit.

12 Claims, 6 Drawing Sheets

(56) References Cited

U.S. PATENT DOCUMENTS

| | | | | |
|---|---|---|---|---|
| 6,557,629 | B2 * | 5/2003 | Wong | E21B 33/068 166/85.1 |
| 6,899,172 | B2 | 5/2005 | McLeod et al. | |
| 7,213,641 | B2 | 5/2007 | McGuire et al. | |
| 7,934,546 | B2 | 5/2011 | McGuire et al. | |
| 8,490,652 | B2 | 7/2013 | Bohaychuk et al. | |
| 8,528,585 | B2 | 9/2013 | McGuire | |
| 9,175,556 | B2 * | 11/2015 | Cherewyk | E21B 43/26 |
| 9,476,531 | B2 | 10/2016 | McMillan | |
| 10,012,325 | B2 * | 7/2018 | Bohaychuk | F16K 11/0716 |
| 10,151,188 | B2 | 12/2018 | Kajaria et al. | |
| 10,876,376 | B2 * | 12/2020 | Robinson | E21B 43/26 |
| 2006/0090891 | A1 * | 5/2006 | McGuire | E21B 33/068 166/177.5 |
| 2011/0180167 | A1 * | 7/2011 | Bohaychuk | F16K 27/041 137/625.3 |
| 2013/0075079 | A1 | 3/2013 | Artherholt | |
| 2016/0060997 | A1 | 3/2016 | Thomas | |
| 2017/0002620 | A1 | 1/2017 | Roesner et al. | |
| 2020/0284132 | A1 * | 9/2020 | Fink | F16L 57/06 |
| 2021/0317719 | A1 * | 10/2021 | Tanaka | E21B 33/03 |

OTHER PUBLICATIONS

International Preliminary Report on Patentability issued in PCT Application PCT/US2019/058322, dated May 14, 2021 (8 pages).
PCT International Search Report and Written Opinion; Application No. PCT/US2019/058322; dated May 14, 2021; 8 pages.

* cited by examiner

EROSION CONTROL SYSTEM

CROSS-REFERENCE TO RELATED APPLICATION

This application is a continuation of U.S. application Ser. No. 16/173,732, filed Oct. 29, 2018, entitled "Erosion Control System," which is hereby incorporated by reference in its entirety for all purposes.

FIELD OF THE INVENTION

The present disclosure relates generally to hydrocarbon extraction systems.

BACKGROUND

This section is intended to introduce the reader to various aspects of art that may be related to various aspects of the present invention, which are described and/or claimed below. This discussion is believed to be helpful in providing the reader with background information to facilitate a better understanding of the various aspects of the present invention. Accordingly, it should be understood that these statements are to be read in this light, and not as admissions of prior art.

Wells are drilled to extract resources, such as oil and gas, from subterranean reserves. These resources can be difficult to extract because they may flow relatively slowly to the well bore. Frequently, a substantial portion of the resource is separated from the well by bodies of rock and other solid materials. These solid formations impede fluid flow to the well and tend to reduce the well's rate of production.

In order to release more oil and gas from the formation, the well may be hydraulically fractured. Hydraulic fracturing involves pumping a frac fluid that contains a combination of water, chemicals, and proppant (e.g., sand, ceramics) into a well at high pressures. The high pressures of the fluid increases crack size and crack propagation through the rock formation, which releases more oil and gas, while the proppant prevents the cracks from closing once the fluid is depressurized. Unfortunately, the high-pressures and abrasive nature of the frac fluid may wear components.

BRIEF DESCRIPTION

In one embodiment, a hydrocarbon extraction system that includes an erosion control system. The erosion control system includes a housing defining a first inlet, a second inlet, and an outlet. The housing receives and directs a flow of a particulate laden fluid between the first inlet and the outlet. A conduit rests within the housing. The conduit changes a direction of the particulate laden fluid and reduces erosion of the housing. The conduit is inserted into the housing through the second inlet. The conduit defines a plurality of apertures between an exterior surface and an interior surface of the conduit. The apertures direct the fluid into a conduit cavity. The conduit guides the fluid entering the conduit cavity to the outlet. The erosion control system excludes a plug and/or a sleeve around or in the conduit.

BRIEF DESCRIPTION OF THE DRAWINGS

These and other features, aspects, and advantages of the present invention will become better understood when the following detailed description is read with reference to the accompanying drawings in which like characters represent like parts throughout the drawings, wherein.

DETAILED DESCRIPTION OF SPECIFIC EMBODIMENTS

One or more specific embodiments of the present invention will be described below. In an effort to provide a concise description of these embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

When introducing elements of various embodiments of the present invention, the articles "a," "an," "the," "said," and the like, are intended to mean that there are one or more of the elements. The terms "comprising," "including," "having," and the like are intended to be inclusive and mean that there may be additional elements other than the listed elements. Moreover, the use of "top," "bottom," "above," "below," and variations of these terms is made for convenience, but does not require any particular orientation of the components.

The present embodiments disclose an erosion control system that reduces erosion of the pipes and other components of a mineral extraction system by an erosive fluid while changing a flow direction of the erosive fluid. The erosive fluid may be a frac fluid, oil carrying particulate (e.g., sediment, rock), among others. Because these fluids flow at high velocities with abrasive materials they may increase wear on hydrocarbon extraction system components as the fluid flow path changes the fluid flow direction. As will be explained below, the erosion control system includes a housing that defines a cavity. A conduit with apertures is placed within the cavity. In operation, the erosive fluid flows through an inlet in the housing and through the apertures in the conduit. The conduit changes the flow direction of the erosive fluid and directs the erosive fluid to an outlet in the housing. The conduit may also reduce turbulence as the fluid flows through the housing by controlling the fluid flow direction. By controlling how the erosive fluid flows through the housing with the conduit, the erosion control system may reduce erosion/wear of the housing. It should be understood that the erosion control system may be used in systems other than mineral extraction systems.

Figure 1:
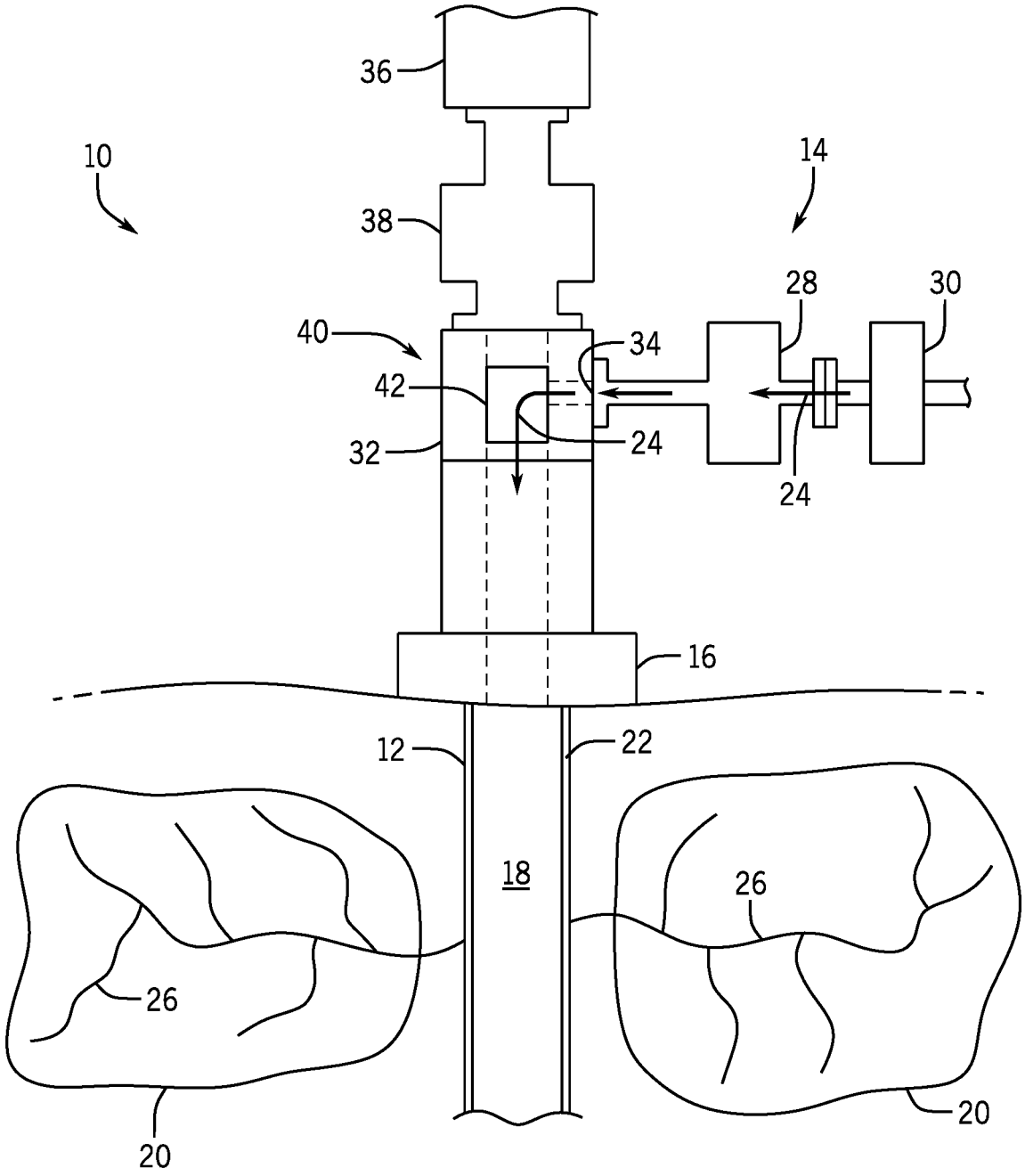
FIG. 1 is a block diagram of an embodiment of a hydrocarbon extraction system.

FIG. 1 is a block diagram that illustrates an embodiment of a hydrocarbon extraction system 10 capable of hydraulically fracturing a well 12 to extract various minerals and natural resources (e.g., oil and/or natural gas). The hydrocarbon extraction system 10 includes a frac tree 14 coupled to the well 12 via a wellhead hub 16. The wellhead hub 16 generally includes a large diameter hub disposed at the termination of a well bore 18 and is designed to connect the frac tree 14 to the well 12. The frac tree 14 may include multiple components that enable and control fluid flow into and out of the well 12. For example, the frac tree 14 may route oil and natural gas from the well 12, regulate pressure in the well 12, and inject chemicals into the well 12.

The well 12 may have multiple oil and/or gas formations 20 at different locations. In order to access each of these formations (e.g., hydraulically fracture), the hydrocarbon extraction system may use a downhole tool coupled to a tubing (e.g., coiled tubing, conveyance tubing). In operation, the tubing pushes and pulls the downhole tool through the well 12 to align the downhole tool with each of the formations 20. Once the tool is in position, the tool prepares the formation to be hydraulically fractured by plugging the well 12 and boring through the casing 22. For example, the tubing may carry a pressurized cutting fluid that exits the downhole tool through cutting ports. After boring through the casing, the hydrocarbon extraction system 10 pumps frac fluid 24 (e.g., a combination of water, proppant, and chemicals) into the well 12.

As the frac fluid 24 pressurizes the well 12, the frac fluid 24 fractures the formations 20 releasing oil and/or natural gas by propagating and increasing the size of cracks 26. Once the formation 20 is hydraulically fractured, the hydrocarbon extraction system 10 depressurizes the well 12 by reducing the pressure of the frac fluid 24 and/or releasing frac fluid 24 through valves (e.g., wing valves).

The frac tree 14 includes valves 28 and 30 that couple to a frac head or housing 32 at a first inlet 34. These valves 28 and 30 fluidly couple to pumps that pressurize and drive the frac fluid into the well 12. In some embodiments, the valves 28 and 30 may be gate valves. To facilitate insertion of tools into the well 12, the fracturing tree or frac tree 14 may include a lubricator 36 coupled to the frac head or housing 32. The lubricator 36 is an assembly with a conduit that enables tools to be inserted into the well 12. These tools may include logging tools, perforating guns, among others. For example, a perforating gun may be placed in the lubricator 36 for insertion in the well 12. After performing downhole operations (e.g., perforating the casing), the tool is withdrawn back into the lubricator 36 with a wireline. In order to block the flow of frac fluid into the lubricator 36 while fracing the well 12, the frac tree 14 includes one or more valves 38, such as gate valves.

As illustrated, as the frac fluid 24 flows through the housing 32, the housing 32 changes the flow path direction of the frac fluid 24. In FIG. 1 the change is ninety degrees; however, it should be understood that the change in direction (i.e., angle) may vary depending on the embodiment. The change in the flow path may increase wear of the housing 32 as particulate repeatedly contacts sections of the housing 32. In order to reduce wear on the housing 32, the hydrocarbon extraction system 10 includes the erosion control system 40. The erosion control system 40 includes the housing 32 and a conduit 42 (e.g., cage) placed within the housing 32. As will be explained below, the conduit 42 receives the frac fluid 24 (e.g., erosive fluid) flowing through the housing 32 and redirects the frac fluid 24 to reduce wear on the housing 32. As the frac fluid 24 flows into and through the conduit 42, the conduit 42 may reduce turbulence of the frac fluid 24.

Figure 2:
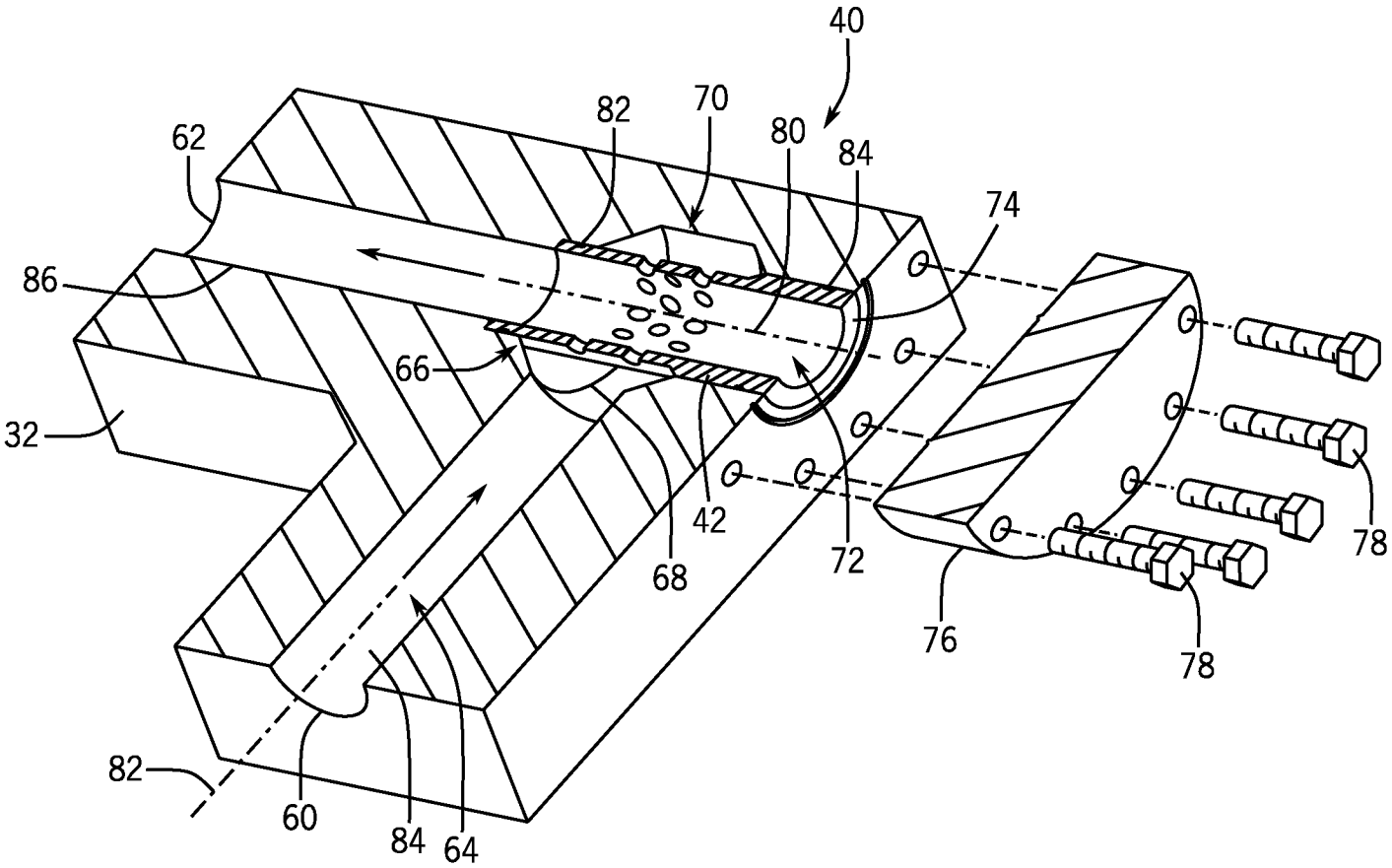
FIG. 2 is a cross-sectional perspective view of an embodiment of an erosion control system.

FIG. 2 is a cross-sectional perspective view of an embodiment of an erosion control system 40. As explained above, the erosion control system 40 includes the housing 32. The housing 32 defines an inlet 60 and an outlet 62 and a flow path 64 between the inlet 60 and the outlet 62. In operation, fluid flows through the housing 32 between the inlet 60 and the outlet 62. However, because of the significant change in direction of the flow path 64 between the inlet 60 and the outlet 62 (e.g., ninety degree bend), an erosive fluid may create undesirable wear on the housing 32. For example, erosive fluid may erode the bend or corner 66 in the housing 32.

In order to redirect the flow of erosive fluid away from the corner 66 and/or other portions of the housing 32, the erosion control system 40 includes the conduit 42 (e.g., cage). The conduit 42 rests within a cavity 68 defined by the housing 32 and receives the fluid through apertures 70 into a conduit cavity 72. The conduit 42 then directs the fluid flow through the conduit cavity 72 to the outlet 62. In some embodiments, the volume of the cavity 68 is at least 1.5 times greater than the volume of the portion of the conduit 42 within the cavity 68. This difference in volume enables the housing 32 to reduce the velocity of the fluid within the cavity 68 and thus reduce the velocity of the fluid before it enters and flows through the apertures 70. Reducing the velocity of the fluid may reduce erosion of the housing 32 and/or the conduit 42. The apertures 70 may be circular, rectangular, semi-circular, etc.

The conduit 42 is inserted into the housing 32 through a second inlet 74. A bonnet 76 may couple to the housing 32 with fasteners 78 over the second inlet 74 in order to retain the conduit 42 within the housing 32. Over time the flow of erosive fluid through the housing 32 and conduit 42 may erode the conduit 42. When this occurs, the conduit 42 may be removed and replaced with another conduit. By replacing the conduit 42, the erosion control system 40 may increase the life of the housing 32 and reduce operating costs. It should be noted that the erosion control system 40 excludes a sleeve and/or plug for opening and closing the apertures 70 in the conduit 42. The apertures 70 are therefore always open and able to transfer fluid between the inlet 60 and the outlet 62.

The apertures 70 extend about the circumference of the conduit 42 and along a longitudinal axis 80 of the conduit 42. In some embodiments, the apertures 70 may be centered on an axis 80 of a first flow passage 84 that extends between the inlet 60 and the cavity 68. In some embodiments, the apertures 70 may be offset from the axis 80 of the first flow passage 84. In FIG. 2, the conduit 42 includes two rows of apertures 70 that extend about the circumference of the conduit 42. However, it should be understood that other embodiments may include different numbers of rows, such as 1, 2, 3, 4, 5, or more. In some embodiments, the size of the apertures and number of apertures may differ between rows. In some embodiments, the spacing between rows may also differ. For example, some rows may be placed closer together. In some embodiments, the apertures 70 may also be arranged to facilitate hydrodynamic energy dissipation. For example, the apertures 70 may be arranged in pairs so that each aperture 70 is aligned with and offset from a corresponding aperture 70 by one-hundred eighty degrees. In operation, fluid flow (e.g., fluid jets) through these pairs of apertures 70 contacts each other in the conduit cavity 72 dissipating/reducing the energy of the fluid before it flows out of the conduit 42.

In some embodiments, the erosion control system 40 may include seals 82 and 84 (e.g. circumferential elastomeric seals) that rest in corresponding grooves on the conduit 42 and/or in the housing 32. The seals 82 and 84 form seals between the housing 32 and the conduit 42, which may reduce erosion of the housing 32 by blocking fluid flow from bypassing the apertures 70 in the conduit 42.

Figure 3:
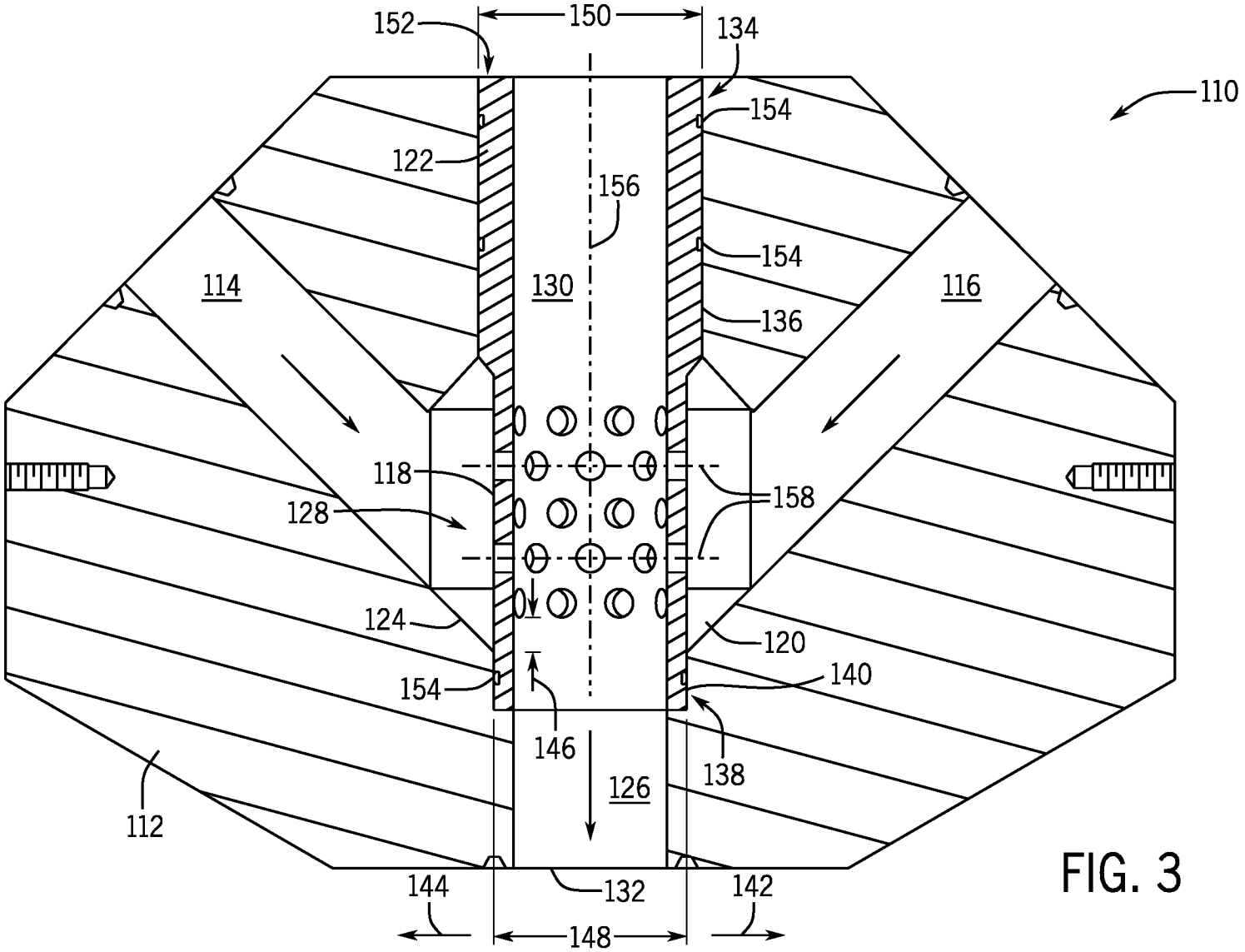
FIG. 3 is a partial cross-sectional view of an embodiment of an erosion control system.

FIG. 3 is a partial cross-sectional view of an embodiment of an erosion control system 110. The erosion control system 110 includes a housing 112 (e.g., frac head, goat head) with multiple flow passages. For example the housing 112 may include a first flow passage 114, a second flow passage 116, and a third flow passage 118 (i.e., behind the conduit 122). It should be understood that the housing 112 may include numbers of flow passages (e.g., 1, 2, 3, 4, 5, 6, or more). The flow passages 114, 116, and 118 direct fluid flow to the cavity 120 containing the conduit 122. Like the discussion above, the conduit 122 reduces wear/erosion on housing 112 by forcing the fluid to flow through the conduit 122. For example, the conduit 122 may reduce undesirable wear around the surface 124 (e.g., bend, edge) proximate the outlet flow passage 126 created by the change in fluid flow direction through the housing 112.

In order to redirect the flow of erosive fluid away from the surface 124, the conduit 122 defines apertures 128 that receive the fluid. As the fluid flows through the apertures 128 the conduit 122 directs the fluid flow through the conduit cavity 130 to the outlet 132. In some embodiments, the volume of the cavity 120 is at least 1.5 times greater than the volume of the conduit 122 within the cavity 120 in order to reduce the velocity of the fluid and thus wear.

The conduit 122 is inserted into the housing 112 through an inlet 134 and into a passage 136. During insertion of the conduit 122, a first end 138 of the conduit 122 passes through the passage 136 and through the cavity 120 before contacting and resting in a counterbore 140. In operation, the counterbore 140 enables the housing 112 to retain the conduit 122 in position within the housing 112. More specifically, the counterbore 140 enables the housing 112 to block and/or reduce movement of the conduit 122 in directions 142 and 144. The counterbore 104 may also properly position the apertures 128 within the cavity 120, or in other words offset the apertures 128 a desired distance 146 from the surface 124.

As illustrated, the first end 138 defines a first diameter 148 that is smaller than a second diameter 150 of a second end 152 of the conduit 122. The difference between the diameters 148 and 150 may facilitate insertion of the first end 138 into the housing 112 and thus placement of the conduit 122 within the housing 112 by enabling the first end 138 to easily pass through the passage 136.

The conduit 122 forms a seal with the housing 112 with one or more seals 154 (e.g. circumferential elastomeric seals) that rest in corresponding grooves on the conduit 122 and/or in the housing 112. Both the first and second ends 138 and 152 include one or more seals 154 that enable the first end 138 to form a seal with the counterbore 140 and a seal between the second end 152 and the passage 136. The seals 154 may reduce erosion of the housing 112 by blocking fluid flow from bypassing the apertures 128 in the conduit 122.

The apertures 128 extend about the circumference of the conduit 122 and along a longitudinal axis 156 of the conduit 122. In FIG. 3, the conduit 122 includes five rows of apertures 128 that extend about the circumference of the conduit 122. However, it should be understood that other embodiments may include different numbers of rows, such as 1, 2, 3, 4, 5, 10, or more. In some embodiments, the apertures 128 may be arranged to facilitate hydrodynamic energy dissipation. For example, the apertures 128 may be arranged in pairs so that each aperture 128 is aligned with and offset from a corresponding aperture 128 by one-hundred eighty degrees (as illustrated with lines 158). In operation, fluid flow (e.g., fluid jets) through these pairs of apertures 128 contacts each other in the conduit cavity 130 dissipating/reducing the energy of the fluid before flowing out of the conduit 122.

While not illustrated, a bonnet or other piece of equipment (e.g., spool, valve) may couple to the housing 112 in order to retain the conduit 122 within the housing 112. Over time the flow of erosive fluid through the housing 112 and conduit 122 may erode the conduit 122. When this occurs, the conduit 122 may be removed and replaced with another conduit. In this way, the erosion control system 110 may increase the life of housing 112, which may reduce operating costs. Again, the erosion control system 40 excludes a sleeve and/or plug for opening and closing the apertures 128 in the conduit 122. The apertures 128 are therefore always open enabling fluid to flow through the conduit 122. In addition, the conduit 122 may reduce turbulence of the fluid as it flows through the housing 112.

Figure 4:
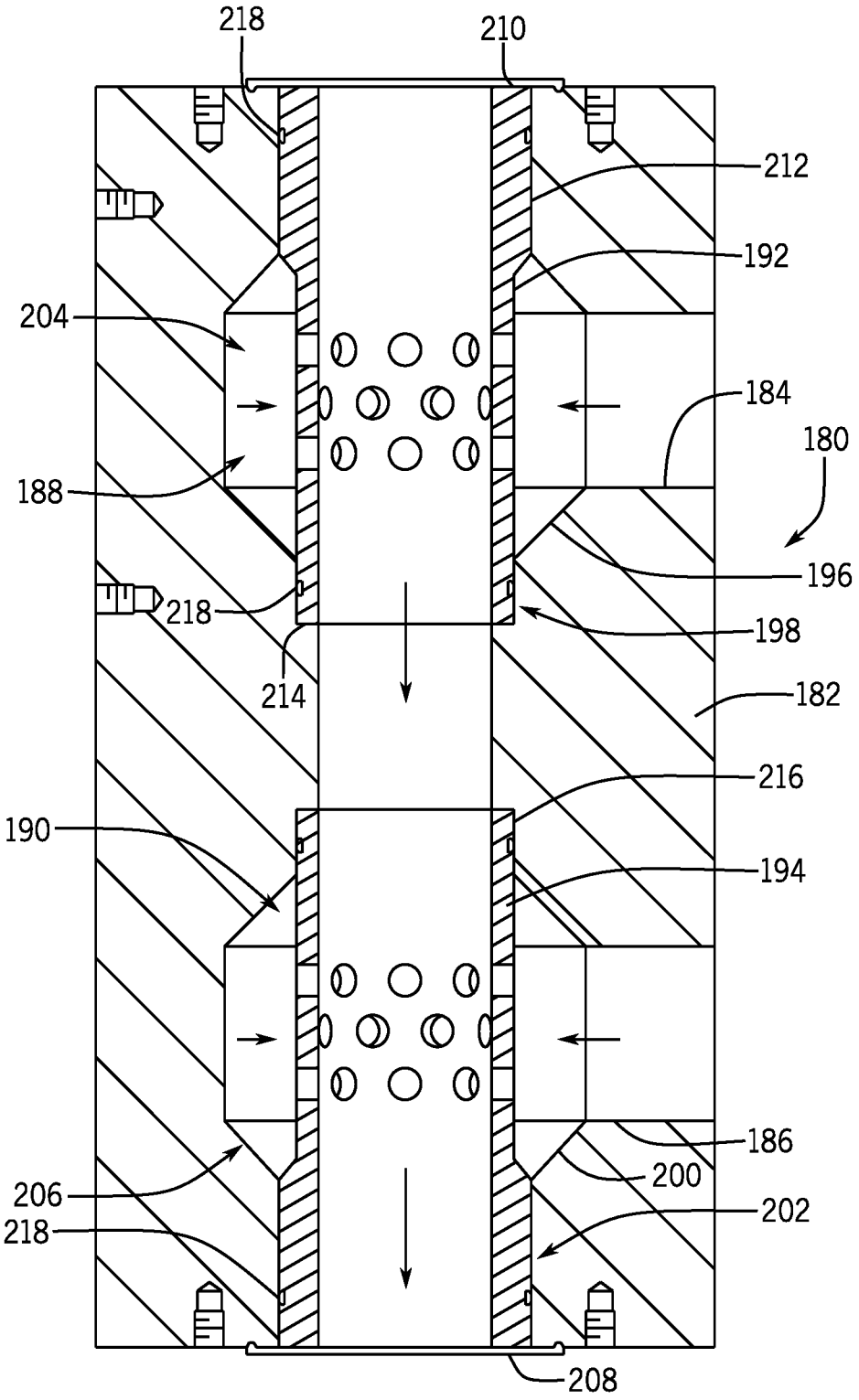
FIG. 4 is a partial cross-sectional view of an embodiment of an erosion control system.

FIG. 4 is a partial cross-sectional view of an embodiment of an erosion control system 180. The erosion control system 180 includes a housing 182 with first and second flow inlet passages 184, 186. It should be understood that the housing 182 may include additional flow passages (e.g., 3, 4, 5, 6, or more). The flow passages 184 and 186 direct fluid flow to respective cavities 238 and 240. Positioned within these respective cavities 238 and 240 are first and second conduits 192 and 194. Like the discussion above, the conduits 192 and 194 reduce wear/erosion on the housing 182 by forcing the fluid to flow through one or both of the conduits 192, 194. For example, the conduit 192 may reduce undesirable wear around the surface 196 (e.g., bend, edge) defining the outlet 198 and around the surface 200 defining the outlet 202.

In order to redirect the flow of erosive fluid away from the surfaces 196 and 200, the conduits 192 and 194 define respective apertures 204 and 206 that receive the fluid. As the fluid flows through the apertures 204 and 206 the conduits 192 and 194 direct the fluid flow to an outlet 208 in the housing 182. As illustrated, the first and second conduits 192 and 194 are in fluid communication. Accordingly, fluid flow through the first conduit 192 will flow through the second conduit 194 before exiting the housing 182 or vice versa. Similar to the discussion above, the volume of the cavities 238 and 240 is at least 1.5 times greater than the volume of the portions of the respective conduits 192, 194 within the cavities 238, 240 in order to reduce fluid velocity.

As illustrated, the conduit 192 is inserted through inlet 210 and into a passage 212. The conduit 192 passes through the passage 212 and through the cavity 238 before contacting and resting in a counterbore 214. The counterbore 214 enables the housing 182 to retain the conduit 192 in position within the housing 182. The conduit 194 is inserted through the outlet 208 and into the passage 212. The conduit 194 passes through the passage 212 and through the cavity 240 before contacting and resting in a counterbore 216. The counterbore 216 enables the housing 182 to retain the conduit 194 in position within the housing 182. The conduits 192 and 194 seal with the housing 182 with one or more seals 218 (e.g. circumferential elastomeric seals) that rest in corresponding grooves on the conduits 192 and 194 and/or the housing 182.

The apertures 204 and 206 extend about the circumferences of the respective conduits 192 and 194. In FIG. 4, the conduits 192 and 194 include three rows of apertures. However, it should be understood that other embodiments may include different numbers of rows, such as 1, 2, 3, 4, 5, 10, or more. The number, size, and/or rows of apertures may differ between the conduits 192 and 194 with one of the conduits defining more apertures, differently sized apertures, and/or more rows of apertures. The apertures 204 and 206 may also be arranged to facilitate hydrodynamic energy dissipation as discussed above.

While not illustrated, bonnets or other pieces of equipment (e.g., spool, valve) may couple to the housing 182 in order to retain the conduit 192 and 194 within the housing 182. Over time the flow of erosive fluid through the housing 182 may erode the conduits 192 and 194. When this occurs, the conduits 192 and 194 may be removed and replaced. In this way, the erosion control system 180 may increase the life of housing 182, which may reduce operating costs. The erosion control system 180 excludes sleeves and/or plugs for opening and closing the apertures 204 and 206 in the respective conduits 192 and 194. The apertures 204 and 206 are therefore always open to fluid flow through the housing 182.

Figure 5:
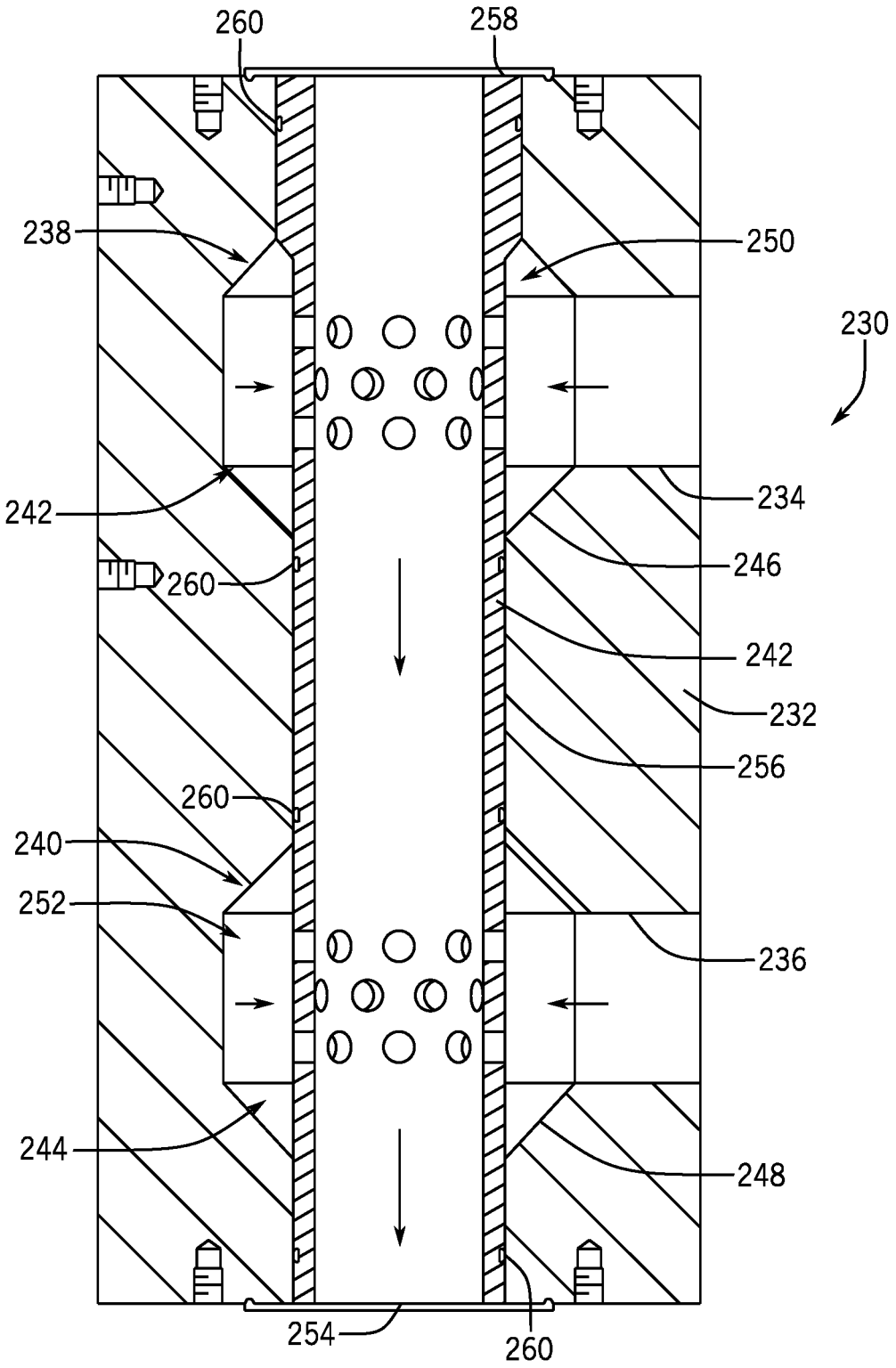
FIG. 5 is a partial cross-sectional view of an embodiment of an erosion control system.

FIG. 5 is a partial cross-sectional view of an embodiment of an erosion control system 230. The erosion control system 230 includes a housing 232 with first and second inlet flow passages 234, 236. It should be understood that the housing 232 may include additional flow passages (e.g., 3, 4, 5, 6, or more). The inlet flow passages 234 and 236 direct fluid flow to respective cavities 238 and 240. Positioned within these respective cavities 238 and 240 is a conduit 242. The conduit 242 reduces wear/erosion on the housing 232 by forcing the fluid to flow through first and second sets of apertures 250 and 252. For example, the conduit 242 may reduce undesirable wear around the surface 246 (e.g., bend, edge) that defines the cavity 238 and around the surface 248 that defines the cavity 240.

After flowing through the apertures 250 and 252, the conduit 242 directs the fluid to an outlet 254 in the housing 232. As illustrated, the conduit 242 is inserted into a passage 256 through an inlet 258 in the housing 232. The conduit 242 seals with the housing with one or more seals 260 (e.g. circumferential elastomeric seals) that rest in corresponding grooves.

The sets of apertures 250 and 252 extend about the circumferences of the conduit 242. As illustrated, the sets of apertures 250 and 252 are positioned within the respective cavities 240 and 242 to receive fluid flow through the inlet passages 234 and 236. The sets of apertures 250 and 252 include three rows of apertures. However, other embodiments may include different numbers of rows, such as 1, 2, 3, 4, 5, 10, or more. The number of apertures, aperture rows, and/or aperture sizes may differ between the sets of apertures 250 and 252. For example one of the sets of apertures 250 or 252 may include more apertures and/or more rows of apertures. The sets of apertures 250 and 252 may also be arranged to facilitate hydrodynamic energy dissipation as discussed above.

While not illustrated, a bonnet or another piece of equipment (e.g., spool, valve) may couple to the housing 232 in order to retain the conduit 242 within the housing 232. Over time the flow of erosive fluid through the housing 232 may erode the conduit 242. When this occurs, the conduit 242 may be removed and replaced. In this way, the erosion control system 230 may increase the life of housing 232. The erosion control system 230 excludes a sleeve and/or plug for opening and closing the sets of apertures 250 and 252 in the conduit 242.

Figure 6:
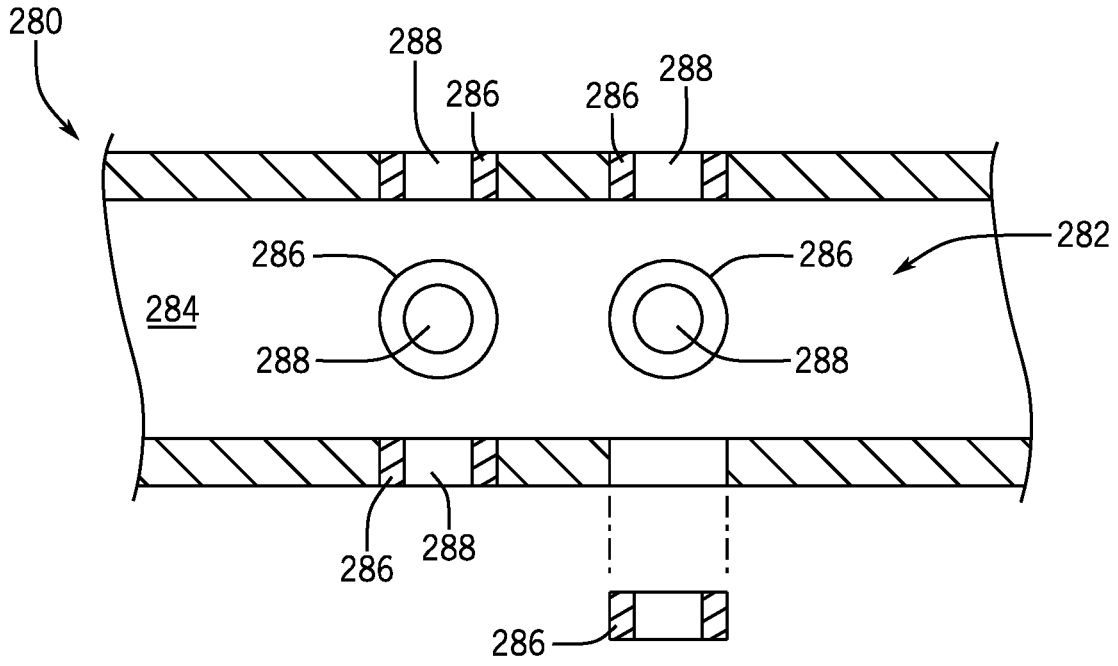
FIG. 6 is a partial cross-sectional view of an embodiment of a conduit of an erosion control system.

FIG. 6 is a partial cross-sectional view of a conduit 280 (e.g., conduits 42, 122, 192, 194, 242) that forms part of an erosion control system (e.g., erosion control system 40, 110, 180, 230). As illustrated, the conduit 280 includes a plurality apertures 282. The apertures 282 enable a fluid to enter a conduit cavity 284. The conduit cavity 284 fluidly communicates with an outlet of the erosion control system enabling the conduit 280 to change a flow direction of a fluid. In some embodiments, the conduit 280 may include inserts 286 (e.g., wear inserts) that are placed within one or more of the apertures 282. The inserts 286 define respective apertures 288 that fluidly communicate with the conduit cavity 284. In some embodiments, the inserts 286 may be made out of a material that is tougher than the material of the conduit 280. For example, the inserts 286 may be made out of polycrystalline diamond, cubic boron nitride, ceramic, tungsten carbide, hardened tool steels, nitrided alloy steels, hardened stainless steels, among others. In operation, these inserts 286 resist erosion of the conduit 280 as an erosive fluid flows through the apertures 282.

Figure 7:
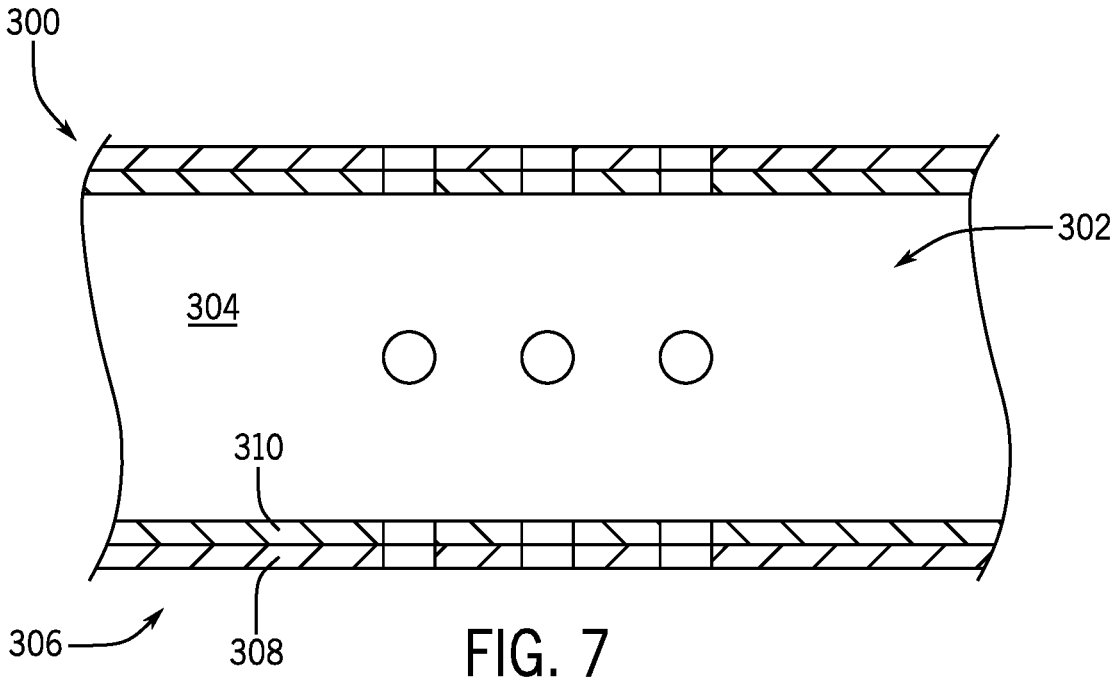
FIG. 7 is a partial cross-sectional view of an embodiment of a conduit of an erosion control system.

FIG. 7 is a partial cross-sectional view of a conduit 300 (e.g., conduits 42, 122, 192, 194, 242) that forms part of an erosion control system (e.g., erosion control system 40, 110, 180, 230). As illustrated, the conduit 300 includes a plurality apertures 302. The apertures 302 enable a fluid to enter a conduit cavity 304. The conduit cavity 304 fluidly communicates with an outlet of the erosion control system. In some embodiments, the conduit 300 may be formed out of a plurality of layers 306 (e.g., 2, 3, 4, 5, or more). As illustrated, the conduit 300 includes a first layer 308 (e.g., outer layer) and a second layer 310 (e.g., inner layer). These layers 306 may be formed from different materials. For example, the first layer 308 may be formed from a softer and/or more ductile material (e.g., low alloy steel, tempered stainless steels, aged stainless steels, tempered alloy steels), while the second layer 310 may be formed from a tougher and/or more abrasion resistant material (e.g., nitride steel, tungsten carbide, hardened stainless steels, hardened tool steels, nitrided alloy steels, ceramics). A softer and/or more ductile material for the first layer 308 may enable the conduit 300 to withstand impacts from material in the fluid flow (e.g., rock) passing through the erosion control system. A tougher and/or abrasion resistant material for the second layer 310 may enable the conduit 300 to resist wear as an abrasive fluid flow enters the apertures 302 and flows through the conduit 300. In some embodiments, the first layer 308 may be formed from a tough and/or more abrasion resistant material, while the second layer 310 may be formed from a softer and/or more ductile material. By forming the conduit 300 out of different layers of material, the conduit 300 may resist wear while changing the direction of a fluid flowing through an erosion control system.

While the invention may be susceptible to various modifications and alternative forms, specific embodiments have been shown by way of example in the drawings and have been described in detail herein. However, it should be understood that the invention is not intended to be limited to the particular forms disclosed. Rather, the invention is to cover all modifications, equivalents, and alternatives falling within the spirit and scope of the invention as defined by the following appended claims.

The invention claimed is:

1. A system, comprising:

an erosion control system, comprising:

a housing comprising first and second passages oriented crosswise relative to one another; and a first erosion control conduit disposed in the housing at a first intersection of the first and second passages, wherein the first erosion control conduit comprises a first axial passage and a first plurality of radial apertures in a first sidewall of the first erosion control conduit, wherein a first fluid flow path extends through the first passage, the first plurality of radial apertures, the first axial passage, and the second passage;

third and fourth passages in the housing, wherein the third and fourth passages are oriented crosswise relative to one another; and a second erosion control conduit disposed in the housing at a second intersection of the third and fourth passages, wherein the second erosion control conduit comprises a second axial passage and a second plurality of radial apertures in a second sidewall of the second erosion control conduit, wherein a second fluid flow path extends through the third passage, the second plurality of radial apertures, the second axial passage, and the fourth passage;

wherein the erosion control system does not comprise a plug and/or a sleeve in the first erosion control conduit to adjust flow through the first plurality of apertures.

2. The system of claim 1, wherein the first sidewall of the first erosion control conduit comprises a first layer and a second layer, the first layer comprises a first material, the second layer comprises a second material, the first material is softer and/or more ductile than the second material, and the second material is more abrasion resistant than the first material.

3. The system of claim 2, wherein:

the first layer is disposed about the second layer relative to a central axis of the first axial passage of the first erosion control conduit; or the first layer is disposed upstream from the second layer relative to a fluid flow direction along the first fluid flow path; or a combination thereof.

4. The system of claim 1, wherein a flow direction of a fluid flow along the first fluid flow path extends through the first passage, the first plurality of radial apertures, the first axial passage, and the second passage, wherein the housing directs an entirety of the fluid flow from the first passage through the first plurality of radial apertures to the first axial passage.

5. The system of claim 4, wherein the first erosion control conduit is sealed to the housing on axially opposite first and second sides of the first plurality of radial apertures.

6. The system of claim 1, wherein the housing comprises a cavity at the intersection between the first and second fluid passages, and the cavity extends about the first erosion control conduit along the first plurality of radial apertures.

7. The system of claim 1, wherein the first axial passage of the first erosion control conduit is coaxial with the second fluid passage of the housing, and a first inner diameter of the first axial passage is equal to a second inner diameter of the second fluid passage.

8. The system of claim 1, wherein the first and second fluid flow paths are fluidly coupled to one another.

9. The system of claim 8, wherein the first and second erosion control conduits are separate from one another.

10. The system of claim 8, wherein the first and second erosion control conduits are integrated together into one-piece.

11. A system, comprising:

a first erosion control conduit configured to mount in a housing at a first intersection of first and second passages oriented crosswise relative to one another, wherein the first erosion control conduit comprises a first axial passage and a first plurality of radial apertures in a first sidewall of the first erosion control conduit, wherein a first fluid flow path extends through the first passage, the first plurality of radial apertures, the first axial passage, and the second passage;

a second erosion control conduit configured to mount at a second intersection of third and fourth passages oriented crosswise relative to one another, wherein the second erosion control conduit comprises a second axial passage and a second plurality of radial apertures in a second sidewall of the second erosion control conduit, wherein a second fluid flow path extends through the third passage, the second plurality of radial apertures, the second axial passage, and the fourth passage, wherein the first and second erosion control conduits are integrated together into one-piece;

wherein the system does not comprise a plug and/or a sleeve in the first erosion control conduit to adjust flow through the first plurality of apertures.

12. The system of claim 11, wherein the first sidewall of the first erosion control conduit comprises a first layer and a second layer, the first layer comprises a first material, the second layer comprises a second material, the first material is softer and/or more ductile than the second material, and the second material is more abrasion resistant than the first material.

* * * * *